US009958241B2

(12) United States Patent
Yusupov

(10) Patent No.: US 9,958,241 B2
(45) Date of Patent: May 1, 2018

(54) CALIBER SHELL WITH RIGID MOUNTING TO HOUSING OF STABILIZING FINS

(71) Applicant: Renat Abdulberovich Yusupov, Sankt-Peterburg (RU)

(72) Inventor: Renat Abdulberovich Yusupov, Sankt-Peterburg (RU)

( * ) Notice: Subject to any disclaimer, the term of this patent is extended or adjusted under 35 U.S.C. 154(b) by 0 days. days.

(21) Appl. No.: 15/321,018

(22) PCT Filed: Aug. 26, 2014

(86) PCT No.: PCT/RU2014/000620

§ 371 (c)(1),
(2) Date: Dec. 21, 2016

(87) PCT Pub. No.: WO2016/032354

PCT Pub. Date: Mar. 3, 2016

(65) Prior Publication Data

US 2017/0205213 A1 Jul. 20, 2017

(51) Int. Cl.
*F42B 7/10* (2006.01)
*F42B 10/02* (2006.01)
(Continued)

(52) U.S. Cl.
CPC ..... *F42B 10/02* (2013.01); *F42B 7/10* (2013.01); *F42B 10/04* (2013.01); *F42B 5/067* (2013.01); *F42B 7/08* (2013.01)

(58) Field of Classification Search
CPC ..... F42B 10/00; F42B 10/02; F42B 10/04; F42B 10/26; F42B 7/08; F42B 7/10;
(Continued)

(56) References Cited

U.S. PATENT DOCUMENTS 2,290,851 A * 7/1942 Addicks ..... F27D 25/006 175/263
3,260,207 A * 7/1966 Kreuzer ..... F42B 7/10 102/518
(Continued)

FOREIGN PATENT DOCUMENTS

DE 1703119 A1 * 2/1973 ..... F42B 7/10
DE 2604137 A1 * 8/1976 ..... F42B 7/10
(Continued)

OTHER PUBLICATIONS

Search report in PCT/RU2014/000620, dated May 14, 2015.

*Primary Examiner* — James S Bergin
(74) *Attorney, Agent, or Firm* — Bardmesser Law Group

(57) ABSTRACT

The invention relates to ammunition for firearms, as smooth and a rifled barrel. The projectile with rigid attached to the housing stabilizing fletching block, plates of fletching block have a continuation on the housing, centering the projectile in the barrel. In the offered variant, on the friction and heat of the bullet and the barrel takes about 1% of the shot energy, besides low vibration. The rest of energy escapes to destination, and that's good. Erasing minimal of the barrel. Application of the projectile in the shotgun and rifle barrels increases the service life of barrels. Use of such projectiles increases the initial speed, and with the sleeve-nozzle and a second charge, allows to increase the speed and specialization of the projectile. At the expense of the aerodynamic and gyroscopic effects, increases the lethal effect over long distances, due to the greater energy saved, improve the close grouping of shots and flat trajectory.

20 Claims, 2 Drawing Sheets

(51) Int. Cl.
*F42B 10/04* (2006.01)
*F42B 5/067* (2006.01)
*F42B 7/08* (2006.01)

(58) Field of Classification Search
CPC .. F42B 14/00; F42B 14/06; F42B 5/00; F42B 5/02; F42B 5/067; F42B 5/184
USPC ..... 102/439, 501, 514, 516, 517, 520, 521, 102/522, 523
See application file for complete search history.

(56) References Cited

U.S. PATENT DOCUMENTS 4,016,817 A * 4/1977 Arciniega Blanco ..... F42B 7/10 102/519
4,063,511 A * 12/1977 Bullard ..... F42B 7/10 102/436
4,419,318 A * 12/1983 Turco ..... F42B 7/10 264/274
7,302,892 B1 * 12/2007 Meyer ..... F42B 7/10 102/522
7,451,706 B2 * 11/2008 Meyer ..... F41A 21/10 102/439
7,654,202 B2 * 2/2010 Romero ..... F42B 7/10 102/438
7,735,422 B2 * 6/2010 Riess ..... F42B 7/08 102/439
8,037,830 B2 * 10/2011 Winter ..... F42B 7/10 102/470
8,087,359 B2 * 1/2012 Sauvestre ..... F42B 5/045 102/439
2017/0205213 A1 * 7/2017 Yusupov ..... F42B 10/02

FOREIGN PATENT DOCUMENTS

DE 2903286 A1 * 8/1980 ..... F42B 7/10
DE 3304393 A1 * 10/1983 ..... F42B 7/10
DE 3622704 A1 * 1/1988 ..... F42B 5/045
DE 212014000272 U1 * 4/2017 ..... F42B 10/26
RU 2405123 C2 11/2010
RU 2011139057 A1 3/2013
WO WO 8301300 A1 * 4/1983 ..... F41A 9/83
WO 2001/11305 A2 2/2001
WO WO 2013154443 A1 * 10/2013 ..... B29C 65/58

* cited by examiner

CALIBER SHELL WITH RIGID MOUNTING TO HOUSING OF STABILIZING FINS

BACKGROUND OF THE INVENTION

The invention relates to ammunition for firearms, for both smoothbore barrels and a rifled barrels.

The following conventional projectile designs are known: a fletched-subcaliber bullet for smooth-bore barrels. D. I. Shiryaev, V. V. Shipilov, N. V. Terehov, SU Patent No. 3246468 A1, published 1 Jan. 1972. This reference is taken as a prototype. In the prototype, a bullet casing with lead core, plastic fletching fixed of the straight tail. Another well-known shell-bullet "Sauvestre", published in "Kalashnikov, weapons, ammunition, equipment" Journal of February 2000, describes a bullet weighing 24 g. The round is subcaliber, with a container. This is a decent round, but the fletching is in the aerodynamic shadow. Another known projectile is shown in application No. RU 2012139499, published on Mar. 20, 2014.

BRIEF DESCRIPTION OF THE ATTACHED DRAWINGS

The attached drawings that further describe the present invention are incorporated in and constitute a part of specification, illustrate embodiments of the invention and together with the description serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings.

Figure 1:
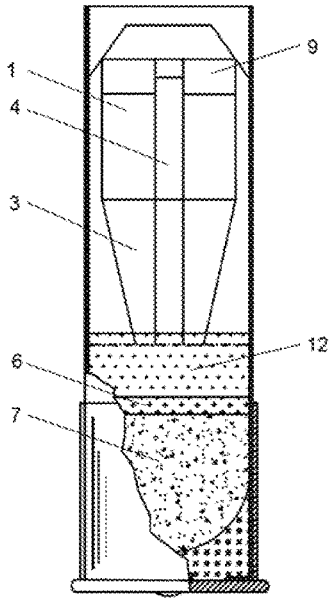
FIGS. 1, 2 illustrate sectional views of the proposed projectile.
Figure 2:
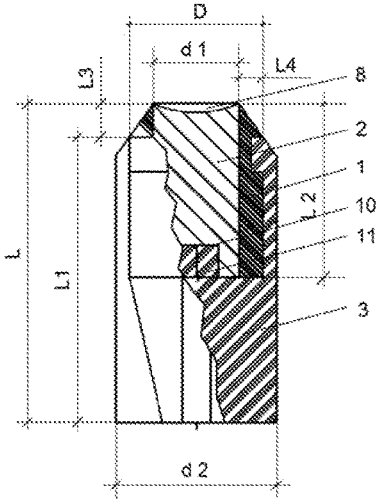
Figure 7:
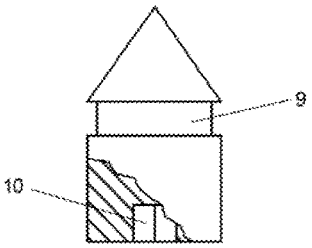
FIG. 7 illustrates the technological groove of the proposed projectile.
Figure 9:
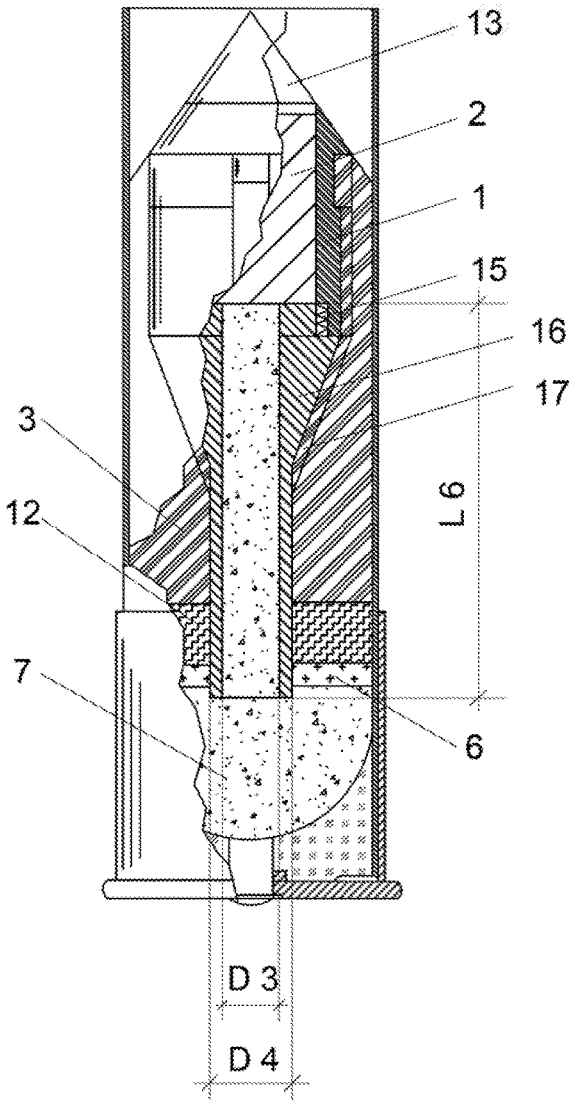
FIG. 9 illustrates a cross-sectional view of an alternative embodiment with the sleeve- nozzle.

The proposed projectile is made in a caliber of a barrel, and includes a housing (body) 1, see FIGS. 1, 2, 9 which is made of steel tubes, non-ferrous metals, such as copper, or their alloys, or from high-strength plastics. The projectile has different diameters d2 and length L2, see FIG. 2, and depending on the caliber, L4, see FIG. 2, and has varying thickness. On top of the housing (body) there is an edge bevel L3, see FIG. 2, to improve the aerodynamic properties of the projectile and its penetrating power. Also on top of the housing (body) there is a technological groove 9, see FIGS. 1, 5, 7 of arbitrary width, for fixing continuation of plates of the fletching block in the top part.

As an alternative with the sleeve-nozzle, see FIG. 9, where the cartridge is shown in sectional view, in the bottom part of the housing at the inner edge there is a threaded connection 15, see FIG. 9, therefore, on the sleeve-nozzle opposing part there is a corresponding thread. The sleeve-nozzle 16, is made of steel or non-ferrous metals such as copper, or alloys thereof, and includes a head and a threaded tube-nozzle of inner diameter d3, and, depending on caliber, of a length L6, which also varies.

In the area of compound of fletching block with the sleeve-nozzle on it, there is a recess 17, see FIG. 9, to prevent turning of the fletching block. The core 2, see FIGS. 2, 5, 9 (which show a projectile in cross-section) with a diameter d1 that depends on the caliber, see FIG. 2, is made of heavy metal, such as lead or steel.

Figure 5:
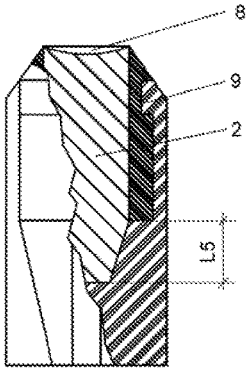
FIG. 5 illustrates how a continuation of the core out of the housing is inserted into the cavity in the form of a polyhedron in the fletching block.
Figure 6:
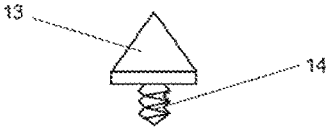
FIG. 6 illustrates the conical lid of the proposed projectile.

As an option, a funnel-shaped cavity is made in the upper part of the core—i.e., an expansive funnel 8, see FIGS. 2, 5. As an alternative to a funnel, on top of housing there is a conical lid 13, see FIGS. 6, 9 with an expansive cavity or without it, see element 14 in FIGS. 6, 9, for locking on the threads in the center core, made of a solid metal, such as steel, nonferrous metals or their alloys, or high strength plastics. In the core in the rear of the housing there is a cavity in the shape of a polyhedron 10, see FIGS. 2, 7, for example—in this illustration—a square, to avoid turning of the fletching block. As an option, a protrusion of the core L5, see FIG. 5, is made in the shape of a polyhedron, e.g., in the form of a square. For technological processing of the steel core, instead of the cavity in the shape of a polyhedron 10, in the core, a cavity is made with a screw thread, and the direction of the thread corresponds to the direction of the barrel rifling.

As an option, with the core made from steel, on a continuation of the core from the housing (body), see FIG. 5, instead of a polyhedron there is a screw thread.

Figure 3:
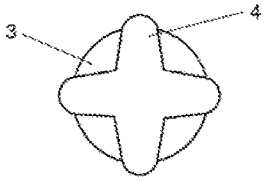
FIG. 3 shows a rear view of the proposed projectile.
Figure 4:
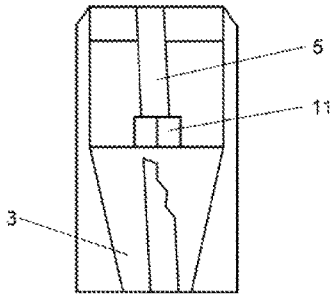
FIG. 4 illustrates the fletching block of the proposed projectile.

The fletching block 3, see FIGS. 1, 2, 3, 4, 9 for smoothbore barrels include stabilizing plates 4.5, see FIGS. 1, 3, 4. FIG. 3 shows a rear view, and the number of plates may be varied. The plates are arranged in a straight line, and have a continuation on the housing L1, see FIG. 2, almost to the front edge, where, in the technological groove, in the housing, there are fixed plates, which center a projectile in the barrel, with the expansion of the area of the plates to the center of the fletching block at their end, for aerodynamic stabilization.

Alternatively, for rifled barrels, the stabilizing plate is disposed at an angle 5, see FIG. 4, also with the transition on the housing, in technological groove in the housing are fixed, with the expansion of the area of the plates to the center of the of fletching block at the end of. In a junction of the housing and the block of fletching, on the block, a ledge 11 in the form of a polyhedron is made, see FIGS. 2, 4, for example, in the form of a square. As an option, in the block there is a cavity under a polyhedron of the continuation of the core L5, see FIG. 5. Diameter d2, see FIG. 2 of the block of fletching of a projectile, is 2-12 percent larger in diameter than the caliber of a barrel, depending on a material of manufacturing. For example, a 12 caliber barrel (18.4 mm), the projectile housing has a diameter of 14 mm, respectively, the height of the plates on the housing is 2.5 mm on each side, and they are not in aerodynamic shadow.

The fletching block is made of high-strength plastics or non-ferrous metals such as copper, or alloys thereof. A rigid mounting of the block to the housing is achieved by inserting the protrusion in the form of a polyhedron of the fletching block, to the cavity in the shape of a polyhedron in the core at the rear of the housing, as well as at the expense of fixation of continuing plates in the technological groove in the upper part of the housing, see FIG. 2.

As an option, a continuation of the core out of the housing L5, see FIG. 5, is inserted into the cavity in the form of a polyhedron in the fletching block, see FIG. 5. In the version with a sleeve-nozzle in the middle of the block, the hole is made with a diameter d4, see FIG. 9.

Also, the housing, the core, the cap and sleeve-nozzle can be manufactured as a single unit from hard material such as steel, non-ferrous metals or alloys thereof. The projectile is inserted at the end of the block of fletching on the wad-obturator 12, see FIGS. 1, 8, in which the size of the cavity is made exactly the same as the end of the fletching block, see FIG. 8. The wad-obturator itself is made of plastic, such as polyethylene, in the diameter of the shell casing, and the wad can have different heights.

Figure 8:
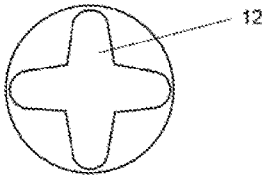
FIG. 8 illustrates how the projectile is inserted at the end of the block of fletching on the wad-obturator in which the size of the cavity is the same as the end of the fletching block.

As an option, with a sleeve-nozzle, a wad hole with a diameter d4 is made, see FIGS. 8, 9. Projectile weight can be 10 grams and higher, length can be 15 mm and longer, see L in FIG. 2.

A gasket 6 is placed on the powder charge 7, see FIGS. 1, 9, then the wad-obturator 12, see FIGS. 1, 9, and on it the projectile, and the shell casing is closed.

As an option, the housing with the sleeve-nozzle, see FIG. 9, the sleeve-nozzle cavity is filled with additional charge, and is inserted into the wad-obturator hole. An additional charge may be of different purposes, tracer, incendiary, fuel, and so on. On a powder charge there is a gasket, then the wad-obturator, and then the projectile.

As an option, the housing with the sleeve-nozzle, on the main powder charge there is a gasket with a hole in the middle under the nozzle, then the wad-obturator is inserted into the opening, and then the projectile with an additional charge.

When fired, at high temperatures and pressure, the contacting part of plates are softened, and the projectile passing through the barrel is centered. It achieves a high initial velocity, since the friction of barrel to the projectile is minimal. Also, ignition of additional charge gives a significant acceleration. The center of gravity of the projectile is in the front, as the aerodynamic stabilization occurs at the expense of the fletching block. In rifled barrels, protruding plates of the block of fletching fall into the rifling and the projectile acquires gyroscopic stability.

Having thus described a preferred embodiment, it should be apparent to those skilled in the art that certain advantages of the described apparatus have been achieved.

It should also be appreciated that various modifications, adaptations, and alternative embodiments thereof may be made within the scope and spirit of the present invention. The invention is further defined by the following claims.

What is claimed is:

1. A projectile comprising:

a body having a central core;

a fletching block rigidly attached to the body;

wherein the fletching block is made of non-ferrous metals or non-ferrous alloys;

the fletching block including stabilizing plates that extend substantially along an entire length of the body, wherein the stabilizing plates are fixed in an annular groove in the body, for centering the projectile inside a barrel, wherein an area of the stabilizing plates increases towards a proximal end of the fletching block, for aerodynamic stabilization of the projectile, and wherein the stabilizing plates extend radially from the body to a larger maximum diameter than a diameter of a barrel from which the projectile is fired.

2. The projectile of claim 1, wherein the stabilizing plates are aligned with a longitudinal axis of the body.

3. The projectile of claim 1, wherein the stabilizing plates are misaligned relative to a longitudinal axis of the body by several degrees.

4. The projectile of claim 1, wherein the body is made of steel, high strength plastics, non-ferrous metals, or non-ferrous alloys.

5. The projectile of claim 1, wherein the annular groove is at a distal end of the body.

6. The projectile of claim 1, wherein the central core is a metallic core, and has a cavity at its proximal end in a shape of a polyhedron.

7. The projectile of claim 1, wherein central core is a metallic core, and has a cavity at its distal end with a screw thread.

8. The projectile of claim 1, wherein central core is a metallic core, and wherein the metallic core has a protrusion in a shape of a polyhedron.

9. The projectile of claim 1, wherein central core is a metallic core, and wherein the metallic core has a protrusion with a screw thread.

10. The projectile of claim 1, wherein the fletching block has a protrusion in a shape of a polyhedron.

11. The projectile of claim 10, wherein the fletching block has a cavity in a shape of a polyhedron.

12. The projectile of claim 11, wherein the protrusion of the fletching block is inserted into the cavity in the body.

13. The projectile of claim 1, wherein the central core has a protrusion which is inserted into a cavity in the fletching block.

14. The projectile of claim 13, wherein the body, the core, a cap and a sleeve-nozzle are integrally made from steel, nonferrous metals copper, or alloys thereof.

15. The projectile of claim 1, wherein a proximal end of the body includes a thread at its inner edge.

16. The projectile of claim 1, wherein the projectile includes a joint sleeve-nozzle which is threaded to a bottom of the body.

17. The projectile of claim 16, wherein the nozzle-sleeve is made of steel non-ferrous metals, copper, or alloys thereof.

18. The projectile of claim 16, wherein the nozzle-sleeve has recess cuts that extend to the body.

19. The projectile of claim 16, wherein the nozzle-sleeve includes an inner hole which is filled with an additional propellant.

20. The projectile of claim 1, wherein the projectile includes a wad-obturator made of plastic.

* * * * *